United States Patent [19]

Thron

[11] 4,016,939

[45] Apr. 12, 1977

[54] BOARD GAME APPARATUS

[76] Inventor: Harry Marshall Thron, Rte. 2, Box 73, Glencoe, Md. 21152

[22] Filed: July 28, 1975

[21] Appl. No.: 599,888

[52] U.S. Cl. ..... 273/134 AT; 273/134 CB; 273/134 DB; 273/134 CA

[51] Int. Cl.[2] ..... A63F 3/00

[58] Field of Search ..... 273/134

[56] References Cited

UNITED STATES PATENTS

| | | | |
|---|---|---|---|
| 1,439,616 | 12/1922 | Diehl | 273/134 D |
| 2,273,292 | 2/1942 | Smith | 273/134 AC |
| 3,556,528 | 1/1971 | Spiring | 273/134 AC |
| 3,801,104 | 4/1974 | Potts et al. | 273/134 AT |

FOREIGN PATENTS OR APPLICATIONS

| | | | |
|---|---|---|---|
| 627,951 | 8/1949 | United Kingdom | 273/134 AT |
| 722,129 | 1/1955 | United Kingdom | 273/134 CB |
| 915,550 | 1/1963 | United Kingdom | 273/134 AT |

*Primary Examiner*—Delbert B. Lowe

[57] ABSTRACT

A game board depicting a land area of natural features and man-made objects surrounded by a border of spaces representing knowledge areas, said land area divided into paths of squares over which the movement of game pieces is directed by chance and by choice of the players.

A set of preferred rules which stress hunting safety and teach the sport of hunting to the novice while simultaneously provided challenge to the experienced hunter.

A plurality of game pieces representing bird and animal wildlife and game pieces representing the players (hunters).

A plurality of cards representing hunting equipment which determine the wildlife to be hunted and accessory equipment to accompany the hunter.

A plurality of cards representing hunting situations which vary the progress of the play.

A die which provides chance movement and selection of cards during the play.

9 Claims, 9 Drawing Figures

BOARD GAME APPARATUS

BACKGROUND OF THE INVENTION

Generally, the present invention relates to board games designed and adapted to develop an understanding and appreciation of a particular sport. While the game board apparatus described herein is directed specifically to hunting, it is apparent that such game board may be adapted to other activities, such as fishing, golf and driver safety education in which the principal features of the invention might be utilized without departing from the spirit and scope of my invention.

Specifically, the present invention relates to a game designed to teach the sport of hunting, particularly the rules of safety in hunting and shooting. The game simulates an unlimited number of hunting situations in which the participant's knowledge, judgment and decisions could adversely affect the wellbeing of himself and others.

Hunting Safety and Conservation Training have become essential to the future of hunting. As the number of hunters increases, the accident potential increases. There is a definite need to create a safer environment in the hunting field, to encourage improved landowner-hunter relations, and to promote an increased awareness of the hunter's significant role in wildlife conservation. Few instructional aids are available to fulfill this need and, while a number of board game devices have been developed to simulate outdoors sports, research of prior art indicates that no such devices have been produced that deal with the learning of safety rules, selection of equipment and simulating actual experiences while hunting.

This game provides both the novice and experienced hunter with an educational and entertaining device to develop or to improve his knowledge, skills, attitudes, and hunting habits while participating in a simulated hunt for various bird and animal wildlife.

OBJECTS

The primary object of this invention is to provide a game board apparatus simulating the actual conditions one encounters when participating in the sport of firearms shooting and hunting and which allows, simultaneously, the teaching of the following subjects: Rules for Safe Hunting and Shooting; Gunology (knowledge of guns and ammunition); Proper Gun Handling; Selection and Care of Equipment; Conservation; Hunting and Shooting Regulations; Game Identification; Survival; Sportsmanship and Landowner-Hunter Relations.

Another object of this invention is to provide a game board apparatus which can be adapted to a broad number of existing or future hunting and shooting regulations which may vary according to the geographic location in which the game is employed.

SUMMARY

I hereby choose to call this game "Hunting Safely", a board game for two or more players, designed to provide each with the opportunity to develop his knowledge, judgment, skill and safe habits in the participation in a simulated hunt as he progresses from the start to the finish.

The player learns basic hunting/shooting safety rules as he proceeds to a point where he selects the equipment required for the hunt. After proceeding to a practice range location where he becomes familiar with the hunting equipment he has selected, he proceeds to a house located on private property where he receives permission to hunt from the landowner. Then he begins pursuit of the wildlife on a hunting area containing natural and man-made obstacles, natural terrain features, wildlife habitat, imaginary persons and other playerhunters. The player is required to make decisions as he proceeds along his choice of paths toward his quarry, the extent and the speed of his progress being controlled by chance, knowledge of the subjects described in Objects of the Invention, and judgment. Penalties are provided for unsafe decisions resulting from lack of knowledge and poor judgment and also by chance in the form of lessons which the player is required to learn by moving his token to the lesson spaces in the knowledge borders of the game board. As the player gains experience, knowledge of the subjects, and good habits by making errors or observing the errors of other players, he learns to anticipate and to avoid unsafe situations which, in real life, could cause fatal accidents, bodily harm or property damage.

The winner of the game is the player who achieves the goal or goals of the rules adopted by the players at the beginning of the game and further described in the preferred embodiment.

DESCRIPTION OF A PREFERRED EMBODIMENT

Figure 1A:
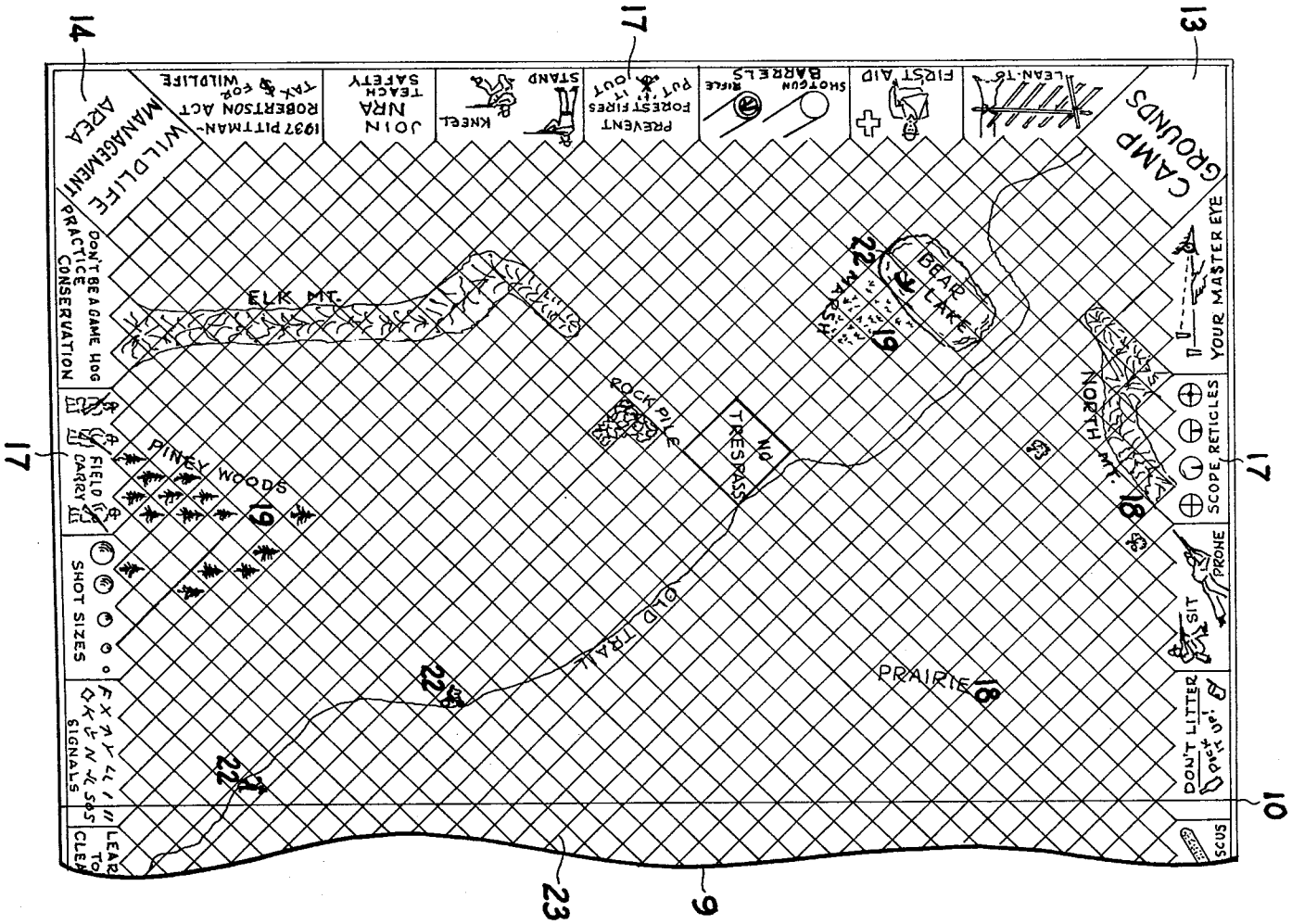
FIGS. 1*a* and 1*b* are partial plan views of a game board according to the present invention.

The game board 9 (FIGS. 1*a* and 1*b*) is preferably foldable along a transverse line 10 for convenient storage when the game is not in use. The four corner spaces of the game board are delineated as Home 11, Store 12, Camp Grounds 13, and Wildlife Management Area 14. Between the corner spaces Home 11 and Store 12 the game board has delineated thereon an outer play path 15 divided into a multiplicity of sequential spaces 16 containing universally accepted basic safety rules necessary to help prevent firearm accidents or directions for movement of a player's token. The remaining three borders of the game board between the corner spaces Store 12, Camp Grounds 13, Wildlife Management Area 14, and Home 11, have delineated thereon a multiplicity of separate spaces 17 each of which depicts a lesson in one of the elements of knowledge described in Objects of the Invention. The central area of the game board has depicted thereon a land area of natural terrain 18, wildlife habitat areas 19, man-made objects 20, domestic animals 21, and humans 22. The central area is superimposed with a grid of squares 23, representing a multiplicity of paths over which the wildlife game pieces may be moved and over which the players may move their token and simulate the Line of Fire and Zone of Fire of their firearm, as will be described in Preferred Rules of Play.

Figure 2:
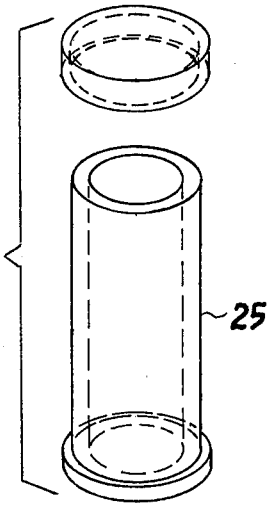
FIG. 2 is a perspective view of a hollow, transparent wildlife display member with a removable cap.
Figure 4:
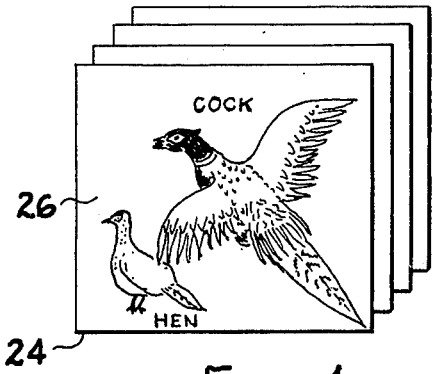
FIG. 4 is a view of a plurality of wildlife indicia which are placed in a display member (FIG. 2).

The Wildlife Indicia 24 (FIG. 4) comprise a plurality of individual, flexible, opaque cards, each of which is dimensionally equal to the inside height and circumference of a transparent Display Member 25 (FIG. 2), and each of which depicts on its display surface 26 one of, a pair of, or a group of, a specie from fifteen preferred wildlife species as follows: deer, elk, moose, bear, antelope, rabbit, squirrel, woodchuck, bobcat, fox, quail, pheasant, grouse, turkey and dove.

Figure 3:
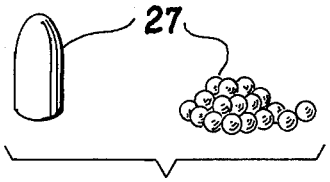
FIG. 3 is a perspective view of a plurality of projectiles which are employed to indicate point values of wildlife according to the preferred rules of play.
Figure 5:
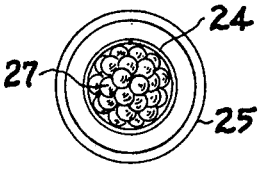
FIG. 5 is a plan view of a display member (FIG. 2) less cap, containing projectiles (FIG. 3) and indicia (FIG. 4).

The assembly of Display Member 25, Indicia 24, and an undisclosed number of projectiles 27 (FIG. 3) comprise a Wildlife Game Piece (FIG. 5) of undisclosed point value.

Figure 6:
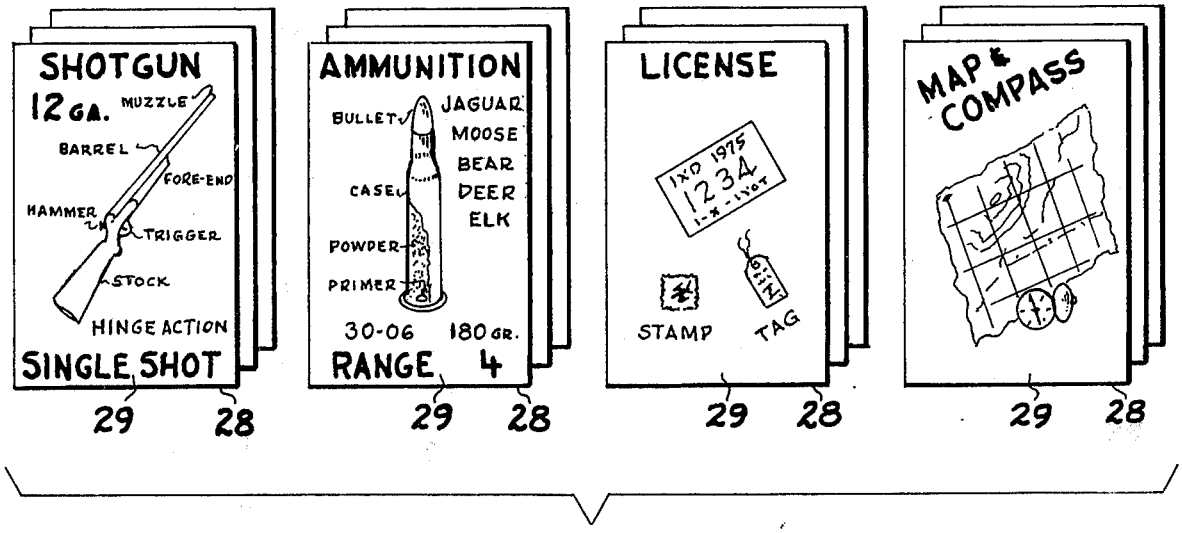
FIG. 6 is a bracketed view of a plurality of cards constituting a deck of Equipment Cards.

The Equipment Card deck (FIG. 6) preferably comprises a plurality of 34 individual, definitely selectable cards 28, each of which depicts on its face 29 an item of necessary hunting equipment or optional accessory equipment. Ten cards represent different types of firearms, ten cards represent different types of ammunition, four cards represent licenses, and ten cards represent different items of accessory equipment.

Figure 7:
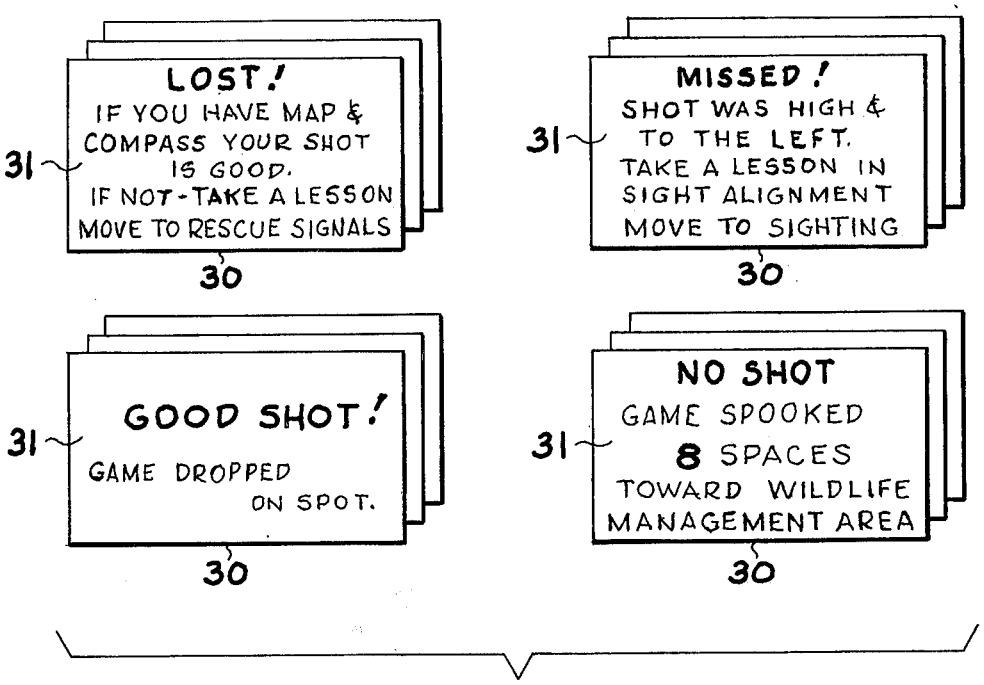
FIG. 7 is a bracketed view of a plurality of cards constituting a deck of Situation Cards.

The Situation Card deck (FIG. 7) provides a chance means of varying the results of a player's simulated shot at his quarry. The Situation Card deck preferably comprises 34 individual, randomly selectable cards 30, each of which bears instructions on its face 31 and most of which direct the movement of game pieces. Ten cards present a situation where the movement of a player's token or the removal of a wildlife game piece is dependent upon his choice of Equipment Cards, eight cards independently dictate a miss and direct movement of a player's token, eight cards independently dictate a kill and removal of a wildlife game piece, and eight cards present a situation where only the movement of a wildlife game piece is directed. Once used, a Situation Card is returned to the bottom of the deck.

Figure 1B:
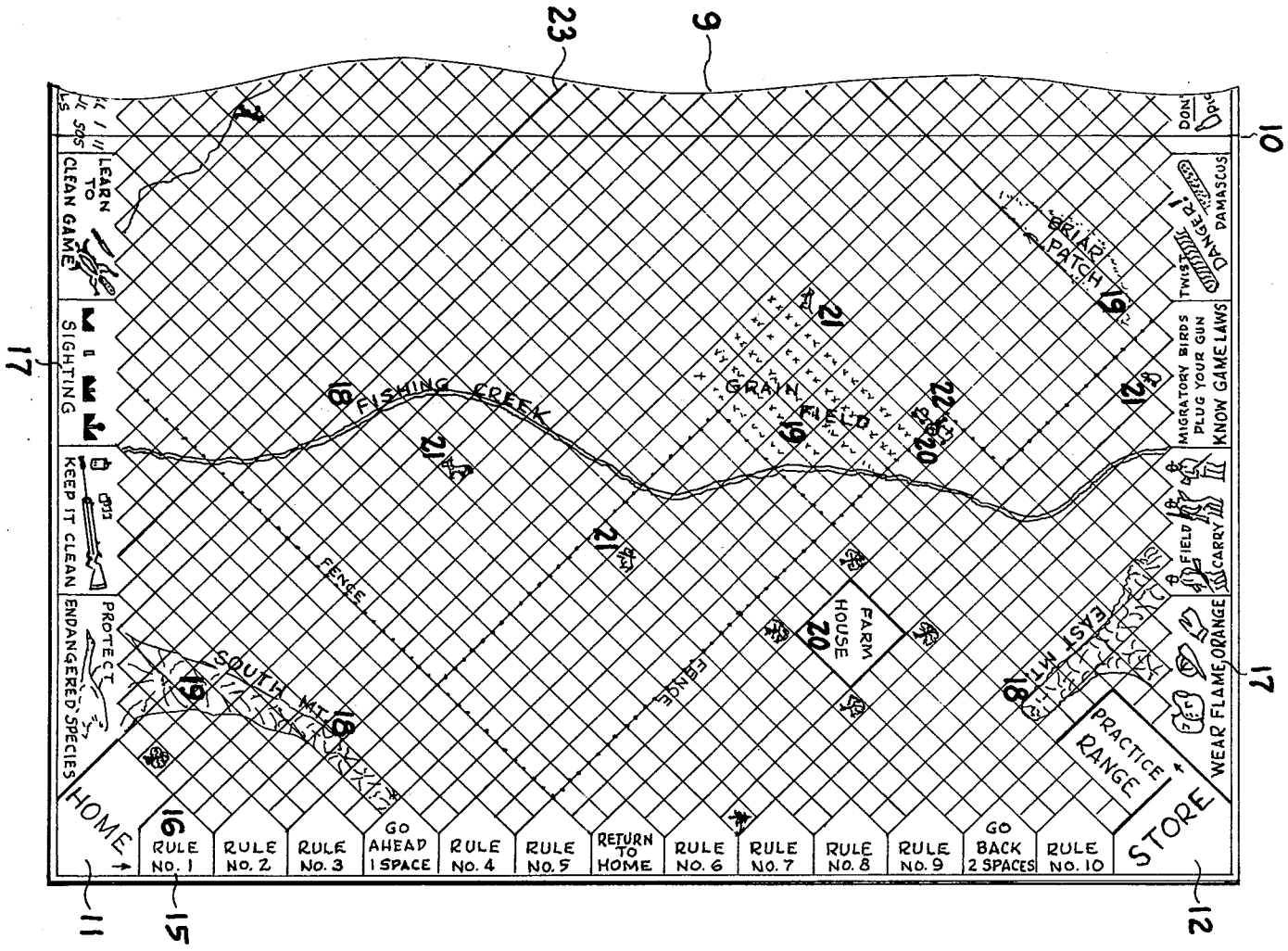
Figure 8:
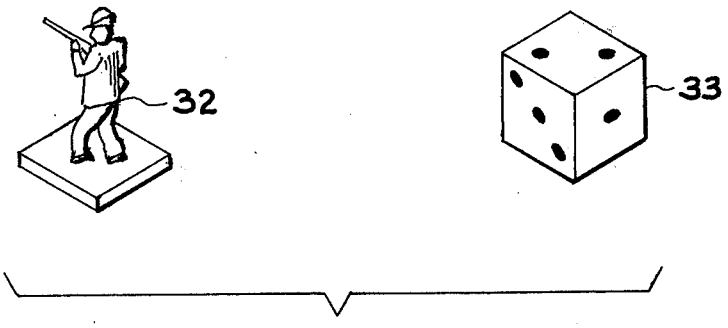
FIG. 8 is a perspective view of one of a plurality of distinguishable playing pieces adapted for indicating the progress of play upon the board and a die for chance determination of the progress of play.

Each player is provided with a movable playing token 32 (FIG. 8) which may be individually identified by color or other indicia. The game equipment also includes a die 33 (FIG. 8) for chance means determination of the extent of advance of each player's token 32 and for chance means determination of the number of Equipment Cards 29 (FIG. 6) that each player may draw per turn while in the space labeled Store 12 (FIG. 1b).

PREFERRED RULES OF PLAY

Objective: To hunt, shoot and return Home safely with three pieces of wildlife of unknown point value.

Definitions:

Hunting Field — that area of the game board bearing a grid of connected square spaces for movement of game pieces.

Knowledge Areas — those areas bordering the Hunting Field which contain subject knowledge (safety rules, conservation practices, etc.)

Lesson Space — a single space of a Knowledge Area which contains instructional information in a specific subject.

Line of Fire — a straight path of connected squares, one space in width, simulating the path of a shooter's projectile(s) on the Hunting Field, from the hunter, past a wildlife target, to the edge of the game board.

Zone of Fire — a straight path of connected squares, three spaces in width, with Line of Fire being the middle path, from the hunter, past a wildlife target, to the edge of the game board.

Safety Zone — any space outlined in red (i.e., Home, Farmhouse, playing path from Home to Store, Store, Practice Range and Camp Grounds).

Range — maximum distance in Hunting Field spaces at which wildlife may be fired upon by Hunter with specific ammunition being used.

"Loaded, Safety On" — a player's verbal declaration that his firearm is loaded with ammunition and the firearm safety is on.

"Safety Off" — a player's verbal declaration that he intends to 'take a shot'.

"Unloaded and Open" — a player's verbal declaration that the ammunition has been removed from his firearm and the action is open and safe.

Take a Shot — to simulate shooting at a bird or animal by drawing a Situation Card.

Display Member — a hollow transparent tube with a cap in which indicia (likenesses of wildlife species) and projectiles are placed; a component of the Wildlife Game Piece.

Wildlife Indicia — flexible opaque cards depicting wildlife species; a component of the Wildlife Game Piece.

Projectile(s) — the bullet or shot pellets from a cartridge or shotshell used to determine the point value of wildlife; a component of the Wildlife Game Piece.

Wildlife Game Piece — an assembly representing a bird or animal and consisting of a display member, wildlife indicia, and a number of projectiles.

Stocking the Hunting Field

A minimum of three Wildlife Game Pieces per player are used in the game. An undisclosed quantity of projectiles representing the point value of the specie is placed in each Wildlife Display Member by a person other than a player. The Wildlife Game Pieces are then placed on the Hunting Field, each in an area where that specie would likely be found in an actual hunting situation. Movement of Game Pieces:

Players must roll the exact number of spaces needed to enter Store, Farm House and Home. A player is not considered a Hunter until leaving the space labeled "Practice Range".

Hunters must move in straight paths, one 90° turn being permitted on a single roll of the die. Wildlife may move in irregular paths with no limit to the number of turns per move.

Hunters and land animals must move around objects that, in real life, they could not walk over. Birds, as if flying, may move over spaces occupied by other objects.

Only one game piece (hunter or wildlife) may occupy a single space in the Hunting Field at the same time.

A hunter retrieves the bird or animal he shoots by moving to the space it formerly occupied.

A hunter resting in a Lesson Space is not considered to be in a Line of Fire or Zone of Fire.

Hunting Regulations

A minimum of three Wildlife Game Pieces per player are placed on the board at the start of the game. All wildlife used in the play of the game is considered legal to shoot except the females of antlered species (deer, elk and moose) and the females of the turkeys and the pheasants.

A hunter must have in his possession five pieces of equipment represented by Equipment Cards before beginning the hunt. A hunter must have the following: (1) Firearm, (2) Ammunition to fit the Firearm, and (3) Hunting License. The remaining two cards must be equipment of the Hunter's choice other than the above.

A hunter must obtain permission to hunt on the Hunting Field by stopping at Farm House before hunting any wildlife.

A hunter may not move onto or through a NO TRESPASSING area.

A hunter must indicate when he is loading his gun by declaring "Loaded, Safety On" and placing his Ammunition Card on top of his Firearm Card. Also, a hunter must declare "Unloaded and Open" and separate his Ammunition Card from his Firearm Card when unloading his gun.

A hunter must announce "Safety Off" when he elects to take a shot at a bird or animal. Opponents must agree that the shooting condition is safe before shooter draws a Situation Card.

A hunter may not take a shot when there is any object in the Line of Fire between the Hunter and wildlife to be shot.

A hunter may not take a shot when another person, domestic animal, piece of machinery, or Safety Zone is in the hunter's Zone of Fire unless those objects are protected by mountainous terrain.

Wildlife entering Wildlife Management Area are considered protected and may not be pursued or disturbed in any other manner.

A hunter may not shoot or possess illegal wildlife or any wildlife specie not sanctioned by his Ammunition Card.

A hunter must stop hunting and move toward Home when he possesses three pieces of wildlife.

Penalties

Any player who detects an infraction of a safety rule or hunting regulation may claim a violation and choose a suitable penalty for the violator from the following:

1. Move violator's token to any Lesson Space.
2. Return one piece of violator's wildlife to game board.
3. Make the violator lose one turn.

A player is penalized one turn when he claims a violation that is incorrect.

Any player who is discovered to be hunting with Ammunition unsuitable for his Firearm must return to the board all of the wildlife he has collected and proceed directly to Store where he returns his Equipment Cards to the bottom of the stack. By rolling the die in turn, he proceeds to select a new set of equipment, moves to Practice Range and resumes the hunt as before.

Scoring

The game terminates when the first player with three pieces of wildlife reaches Home. The projectiles contained in the Wildlife Display Members collected by each player are counted and scored as follows:

Each bullet — 10 points

Each piece of shot — 1 point

PLAY OF THE GAME UNDER PREFERRED RULES

PREPARATION

The players position themselves around the game board, select the birds and/or animals to be hunted and place the indicia for each in a separate display member. The instructor, or any disinterested person who is not playing the game, out of sight of the players, places an undisclosed quantity of projectiles in each display member thereby establishing a point value for that bird or animal. The players place each Wildlife Game Piece on a single square of the hunting area of the game board where they believe that bird or animal would most likely be found in real life.

The Equipment Cards and shuffled and placed face down in a stack next to the corner Store of the game board. The Situation Cards are shuffled and placed face down in a stack next to the corner Wildlife Management Area of the game board. Each player chooses a token to represent him as a hunter moving about the game board.

The play of the game is divided into three distinct phases to add educational value and to simulate the actual sequence of actions one should take to properly prepare for participating in the sport of hunting. These phases are: (I) LEARNING THE BASIC SAFETY RULES, (II) SELECTING THE EQUIPMENT, and (III) THE HUNT ITSELF.

The three phases of learning the rules, selecting the equipment, and participating in the sport, are generally applicable to all sports activities and provide a framework for learning and discussion.

PHASE I — LEARNING THE BASIC SAFETY RULES

Each player places his token on the space labeled Home and rolls the die once. The player rolling the highest number begins the game by rolling the die again, moving his token the number of indicated spaces along the path from Home to Store. If the player's token lands on a space directing movement, he follows the instructions thereon. When the player's token rests on a space containing a basic safety rule, he reads the safety rule aloud, passing the die to the next player to the left. More than one token may rest on the same safety rule space at the same time. The play continues around the board, each player citing the safety rule on which his token rests, until he reaches the space labeled Store.

PHASE II — SELECTING THE EQUIPMENT

On his next roll of the die after reaching the space labeled Store, each player takes from the top of the stack the number of Equipment Cards indicated by his roll of the die, selects one card and returns the remainder, if any, to the bottom of the deck. On each of his turns while in the space labeled Store, a player retains one card until he has a maximum of five. After accumulating five, he may continue to select a card from the number indicated by his roll of the die, returning the same number to the deck, until he is satisfied that he has three of the mandatory cards and two of the optional cards:

1. Firearm

Mandatory

2. Ammunition to match the firearm
3. License

Optional

4. & 5. First Aid Kit, Map & Compass, Knife, etc.

When a player is satisfied that he has accumulated the five equipment cards with which he will hunt, he declares on his next turn that he is going afield and, without rolling the die, moves his token from the space labeled Store to the space labeled Practice Range and places his Equipment Cards face up in front of him on the table.

PHASE III — THE HUNT

Moving to the space labeled Practice Range emphasizes the importance of practicing with new equipment before hunting. After reaching Practice Range, each player, on his next roll of the die, moves his token the indicated number of spaces along his choice of paths in the grid of the hunting area toward the space labeled Farm House. As each player reaches Farm House, he is given permission from the owner to hunt on all of the hunting area except that space which is labeled NO TRESPASSING and is also cautioned to be aware of the presence of livestock, campers and an occasional hiker or cyclist. Moving to the space labeled Farm House emphasizes the importance of good Hunter-Landowner relations. On his next and subsequent rolls of the die, the player moves his token the indicated number of spaces along a path and in the direction of his choice toward a Wildlife Game Piece that his Ammunition Equipment Card indicates.

During the entire hunt, each player must observe and practice the basic safety rules or be penalized for failure to do so. When a player chooses to load his gun, he manually indicates that he is loading his gun by placing his Ammunition Card on top of his Firearm Card and announcing that his gun is "Loaded, Safety On". Likewise, a player indicates that he is unloading his gun by separating his Ammunition and Firearm Cards and announcing that his gun is "Unloaded and Open".

When a player observes an infraction of a safety rule or hunting regulation by another player, that player claims a "violation", cites the infraction, and designates a penalty to the violator as prescribed by the Rules of Play.

Each player's Ammunition Card specifies the maximum number of grid spaces his token may be from a Wildlife Game Piece when simulating a shot at his quarry. Once a player's token is within that maximum range, the player may, instead of rolling the die, elect to shoot by announcing "Safety Off". If, at this stage, an unsafe shooting condition is claimed by another player, the shooter is penalized by the claimant according to the Rules of Play. If all players agree that the shooting conditions are safe, the shooter draws one Situation Card from the top of the deck, follows the instructions thereon and returns the card to the bottom of the deck. The die is then passed to the next player and play proceeds.

The Situation Cards, providing an additional element of chance, determine the results of the hunter's shot or provide a situation dependent upon the player's choice of equipment. If the Situation Card indicates a kill, the player removes the Wildlife Game Piece from the board and moves his token to the space formerly occupied by it. If the Situation Card indicates a miss, it may or may not instruct the moving of the player's token and/or the Wildlife Game Piece. Usually, a Situation Card referring to the player's choice of equipment (Equipment Cards) will dictate a kill if the player has chosen a specific Equipment Card or will dictate a penalty (movement to a lesson space) if he does not possess a specific Equipment Card.

A move to a lesson space teaches a player by exposing him to another element of knowledge. When a player's token is moved to a lesson space as a result of a penalty, he is considered out of the hunting area and his position can in no way affect the safety condition of another player's situation. His token remains there only until his next roll of the die.

Each player continues, in turn, to pursue and bag three Wildlife Game Pieces that are indicated by the Ammunition Card he possesses. If, as a result of a penalty, he is required to return a Wildlife Game Piece to its initial habitat area on the board, he may again pursue it. Once a player has accumulated three Wildlife Game Pieces, he must proceed toward the space labeled Home.

When one player reaches Home with his three Wildlife Game Pieces, the game is over. Each player counts the point value of the projectiles contained in the Wildlife Game Pieces he has accumulated and the player with the highest point value is declared the winner.

I claim:

1. A game apparatus comprising:

a. a playing board depicting an area divided into a plurality of progress spaces and surrounded by a plurality of lesson spaces for instructional purposes;

b. means for selectively displaying a quarry dimensioned to, positionable upon, and movable about said progress spaces;

c. a plurality of pictorial representations of a plurality of specific items of equipment that each player may selectively employ in the play of the game;

d. means for indicating the position of the game players dimensioned to and positionable upon said progress spaces;

e. a deck of cards to provide a number of situations that when drawn by the player will alter the play of the game;

f. chance means to determine the number of progress spaces a player moves his player position indicating means and to determine the rapidity of selection of each player's pictorial representations of items of equipment.

2. An apparatus according to claim 1 wherein said area comprises representations of natural terrain, man-made features, wildlife habitat areas, domestic animals, and human beings.

3. An apparatus according to claim 1 wherein said quarry comprises a likeness of a wildlife specie.

4. An apparatus according to claim 1 wherein said pictorial representations comprise a deck of cards depicting said items of equipment.

5. An apparatus according to claim 4 wherein said deck of cards depict different types of firearms, different types of ammunition, different items of accessory equipment, and hunting licenses.

6. An apparatus according to claim 1 wherein said player position indicating means comprises a likeness of a hunter.

7. An apparatus according to claim 1 wherein a number of said cards independently dictate a miss and direct movement of the player position indicating means, a number independently dictate a kill and direct removal of the quarry from the game board, and a number dictate the movement of the quarry only.

8. An apparatus according to claim 1 wherein said chance means comprises a die.

9. An apparatus according to claim 1 wherein said display means comprises a plurality of hollow transparent tubes with caps, a plurality of flexible opaque cards of such size as to permit insertion into said tubes, said cards depicting wildlife species, and a plurality of projectiles sufficient in number to permit the use of different numbers of projectiles in different tubes for determining the point values of the wildlife species.

* * * * *